US009680222B2

(12) United States Patent
Lin

(10) Patent No.: US 9,680,222 B2
(45) Date of Patent: Jun. 13, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 230 days.

(21) Appl. No.: 14/576,791

(22) Filed: Dec. 19, 2014

(65) Prior Publication Data

US 2015/0318601 A1 Nov. 5, 2015

(30) Foreign Application Priority Data

Apr. 30, 2014 (CN) ..... 2014 1 0179877

(51) Int. Cl.

| | |
|---|---|
| ***H01Q 1/24*** | (2006.01) |
| ***H01Q 5/371*** | (2015.01) |
| ***H01Q 1/48*** | (2006.01) |
| ***H01Q 21/28*** | (2006.01) |
| ***H01Q 5/328*** | (2015.01) |
| *H01Q 9/28* | (2006.01) |
| *H01Q 21/06* | (2006.01) |
| *H01Q 1/12* | (2006.01) |
| *H01Q 3/44* | (2006.01) |
| *H01Q 13/10* | (2006.01) |

(52) U.S. Cl.

CPC ..... *H01Q 5/371* (2015.01); *H01Q 1/243* (2013.01); *H01Q 1/48* (2013.01); *H01Q 5/328* (2015.01); *H01Q 21/28* (2013.01); *H01Q 1/1207* (2013.01); *H01Q 3/44* (2013.01); *H01Q 9/285* (2013.01); *H01Q 13/10* (2013.01); *H01Q 21/061* (2013.01)

(58) Field of Classification Search

CPC ..... H01Q 1/243; H01Q 3/44; H01Q 13/10; H01Q 9/285; H01Q 1/1207; H01Q 21/061

USPC ..... 343/702, 700, 893, 878, 767, 795

See application file for complete search history.

(56) References Cited

U.S. PATENT DOCUMENTS

2011/0260931 A1* 10/2011 Tsai ..... H01Q 1/2266 343/702

* cited by examiner

*Primary Examiner* — Joseph Lauture

(74) *Attorney, Agent, or Firm* — Steven Reiss

(57) ABSTRACT

A wireless communication device includes a metallic housing and an antenna structure. The metallic housing includes a bottom frame and a side frame spaced from the bottom frame. The antenna structure includes a feed end plate, a ground end plate, a main radiator, and a coupling section. The ground end plate is coupled to the bottom frame. The main radiator is coupled between the feed end plate and the side frame. The coupling section is coupled to the main radiator and extending parallel to the bottom frame. A first end of the coupling section is coupled to a distal end of the feed end plate, and a second end of the coupling section extends towards the ground end plate, current is coupled from the feed end plate to the ground end plate via the coupling section and is coupled from the coupling section to the bottom frame.

19 Claims, 5 Drawing Sheets

ANTENNA STRUCTURE AND WIRELESS COMMUNICATION DEVICE USING THE SAME

FIELD

The subject matter herein generally relates to antenna structures, and particularly to a multiband antenna structure, and a wireless communication device using the same.

BACKGROUND

Antennas are used in wireless communication devices such as mobile phones. The wireless communication device uses a multiband antenna to receive/transmit wireless signals at different frequencies, such as wireless signals operated in a long term evolution (LTE) band.

BRIEF DESCRIPTION OF THE DRAWINGS

Implementations of the present technology will now be described, by way of example only, with reference to the attached figures.

DETAILED DESCRIPTION

Figure 1:
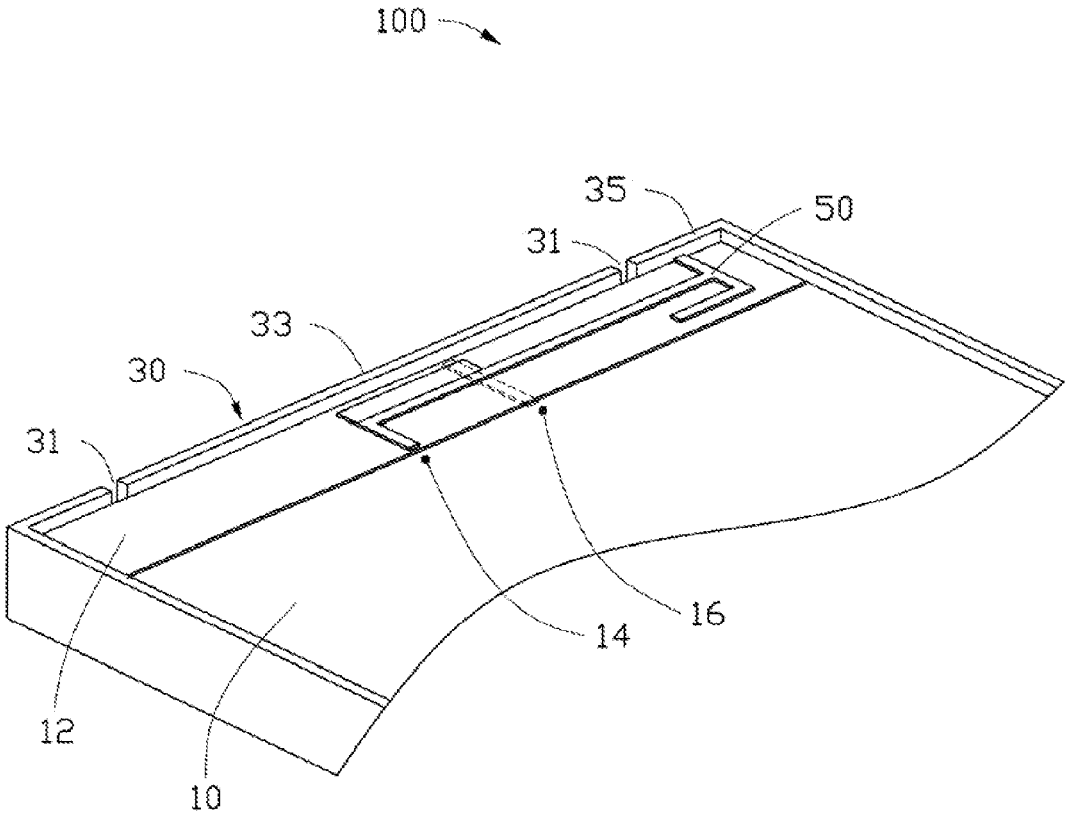
FIG. 1 is an isometric view of a wireless communication device employing an antenna structure, according to a first exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

Figure 2:
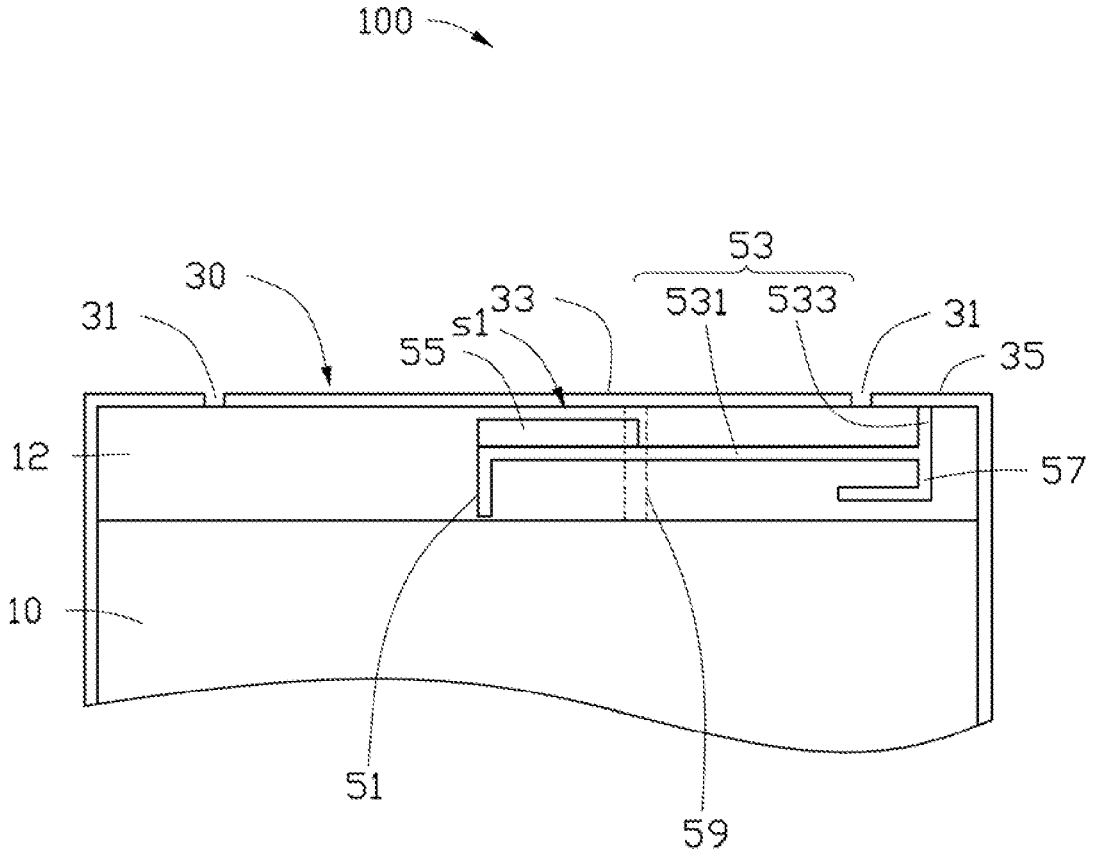
FIG. 2 is a diagrammatic view of the wireless communication device of FIG. 1.

FIGS. 1-2 illustrate an embodiment of a wireless communication device 100 employing an antenna structure 50, according to a first exemplary embodiment. The wireless communication device 100 can be a mobile phone, a tablet, or an intelligent watch, for example (details not shown). The wireless communication device 100 further includes a baseplate 10 and a metallic housing 30 surrounding the baseplate 10. The antenna structure 50 is disposed on the baseplate 10 and is coupled to the metallic housing 30.

The baseplate 10 can be a printed circuit board (PCB) of the wireless communication device 100. The baseplate 10 forms a keep-out-zone 12. The purpose of the keep-out-zone 12 is to delineate an area on the baseplate 10 in which other electronic components (such as a camera, a vibrator, a speaker, etc.) cannot be placed. In at least one embodiment, the keep-out-zone 12 is disposed on an end of the baseplate 10. A feed pin 14 and a ground pin 16 are formed on the keep-out-zone 12, the feed pin 14 is configured to provide current to the antenna structure 50, and the antenna structure 50 can be grounded by the ground pin 16.

The metallic housing 30 can be an outer frame of the wireless communication device 100. Two slits 31 are defined on the metallic housing 30 to divide the metallic housing 30 into a bottom frame 33 and a side frame 35 spaced from the bottom frame 33. In detail, the bottom frame 33 can be disposed at an end of the wireless communication device 100 and is positioned at an end of the keep-out-zone 12, and the side frame 35 surrounds the baseplate 10. In at least one embodiment, both the bottom frame 33 and the side frame 35 can be served as a part of the antenna structure 50. A width of the slit 31 can be about 1.5 mm, and the two slits 31 are symmetrically defined on two distal ends of the side frame 35. In other embodiments, the two slits 31 can be defined at any positions of the metallic housing 30, at this time, the side frame 35 can be an asymmetric structure.

In addition, the antenna structure 50 further includes a feed end plate 51, a main radiator 53, a coupling section 55, an extension section 57, and a ground end plate 59. In at least one embodiment, the feed end plate 51, the main radiator 53, the coupling section 55, and the extension section 57 are located at a first plane of the keep-out-zone 12, and the ground end plate 59 is located at a second plane of the keep-out-zone 12.

The feed end plate 51 is coupled to the feed pin 14 of the baseplate 10 to receive signals, and the ground end plate 59 is coupled between the ground pin 16 of the baseplate 10 and the bottom frame 33. Thus, at least one current path can be formed on the antenna structure 50 to allow the antenna structure 50 to receive/transmit wireless communication signals. In at least one embodiment, the feed end plate 51 is parallel to the ground end plate 59.

The main radiator 53 is substantially an L-shaped sheet and includes a radiation section 531 and a connection section 533. The radiation section 531 is perpendicularly connected to the feed end plate 51 and extends towards the side frame 35. The connection section 533 is perpendicularly connected between the radiation section 531 and the side frame 35.

The coupling section 55 and the extension section 57 extend from two ends of the radiation section 531. In detail, the coupling section 55 is connected to a side of the radiation 531 and extends parallel to the bottom frame 33. Thus, a gap s1 is defined between the coupling section 55 and the bottom frame 33, and a width of the gap s1 can be about 1 mm. In addition, a first end of the coupling section 55 is coupled to a distal end of the feed end plate 51, and a second end of the coupling section 55 is substantially aligned with the ground end plate 59. Thus, the current can be coupled from the feed end plate 51 to the ground end plate 59 via the coupling section 55, and can also be coupled from the coupling section 55 to the bottom frame 33 via the gap s1. In at least one embodiment, the coupling section 55 is a rectangular sheet, and a length of the coupling section 55 is less than a length of the radiation section 531.

The extension section 57 is connected to a junction of the radiation section 531 and the connection section 533. In at least one embodiment, the extension section 57 is substantially an L-shaped sheet. In detail, the extension section 57 extends away from the connection section 533 and then bends towards the feed end plate 51.

When the current is input to the feed end plate 51, the current flows to the main radiator 53 and the side frame 35. In addition, the current is coupled from the feed end plate 51 to the ground end plate 59 via the coupling section 55, and then flows to the bottom frame 33. Thus, the radiation portion 531, the ground end plate 59, and the bottom frame 33 resonates a first low frequency mode. Additionally, the radiation portion 531, the ground end plate 59, the bottom frame 33, and the side frame 35 resonates a first high frequency mode. Furthermore, the radiation portion 531 and the side frame 35 resonates a second high frequency mode. Moreover, the current flowing on the radiation portion 531, the ground end plate 59, and the bottom frame 33 resonates a third high frequency mode due to frequency-doubled effect, and the third high frequency mode can be fine tuned by the extension section 57. In at least one embodiment, a central frequency of the first low frequency mode can be, for example, about 850 MHz, a central frequency of the first high frequency mode can be, for example, about 1400 MHz, a central frequency of the second high frequency mode can be, for example, about 2140 MHz, and a central frequency of the third high frequency mode can be, for example, about 2800 MHz.

Figure 3:
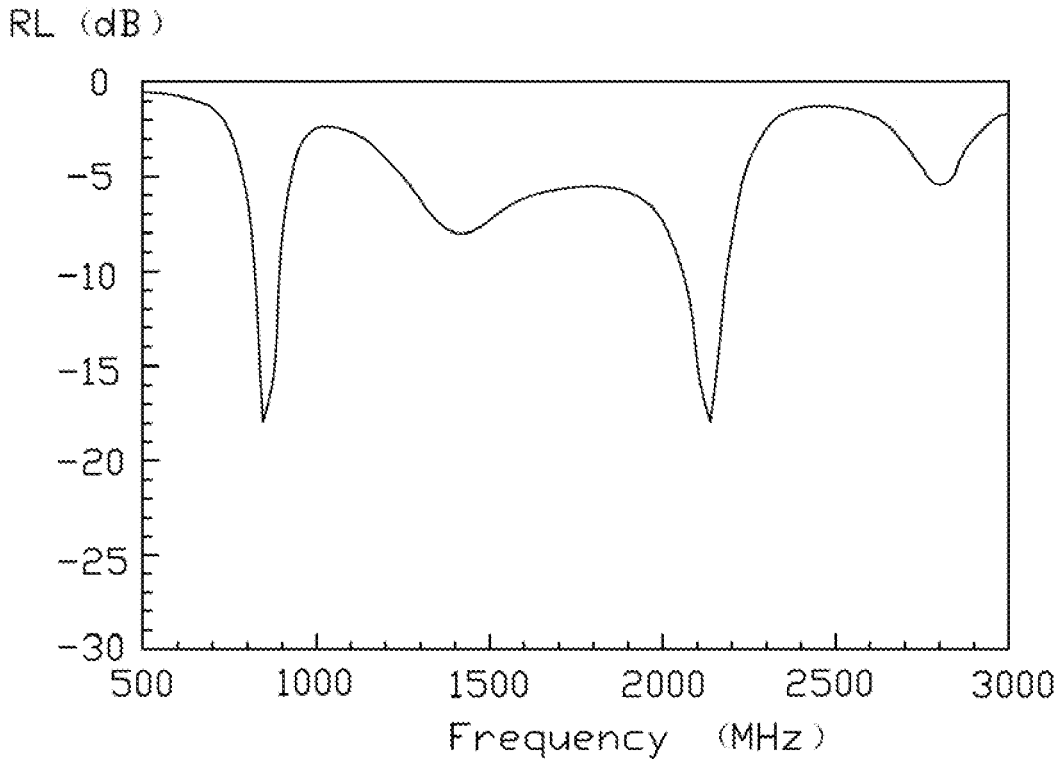
FIG. 3 is a return loss (RL) graph of the antenna structure of FIG. 1.

FIG. 3 illustrates a return loss (RL) curve of the antenna structure 50, according to the first exemplary embodiment. When a length of the radiation section 531 is about 32 mm, a length of the extension section 57 is about 10 mm, a length of the ground end plate 59 is about 8.5 mm, and a 2-dimensional (2D) size (length and width) of the coupling section 55 is about 12 mm by 2 mm, the antenna structure 50 is activated to receive and transmit wireless signals at a first bandwidth which can be for example about 790 MHz to about 920 MHz and a second bandwidth which can be for example about 1300 MHz to about 2200 MHz.

Figure 4:
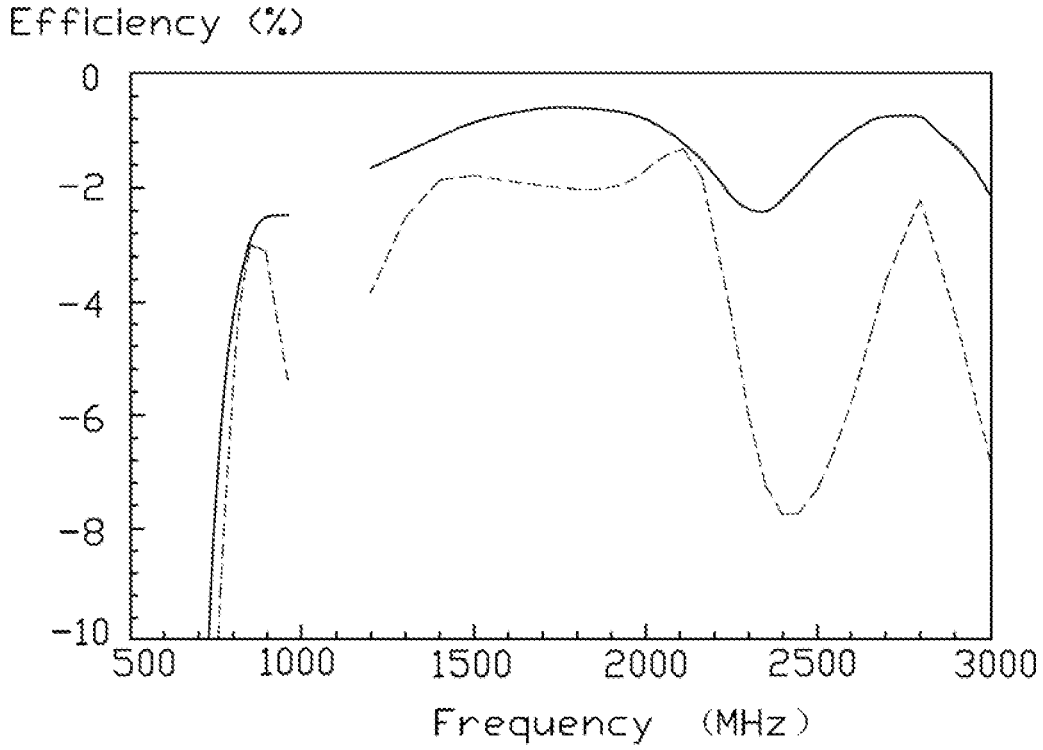
FIG. 4 is an antenna efficiency graph of the antenna structure of FIG. 1.

FIG. 4 illustrates an antenna efficiency of the antenna structure 50. In view of curves shown on FIG. 4, the wireless communication device 100 has good performance when operating at about 790 MHz to about 920 MHZ and about 1300 MHz to about 2200 MHZ.

Figure 5:
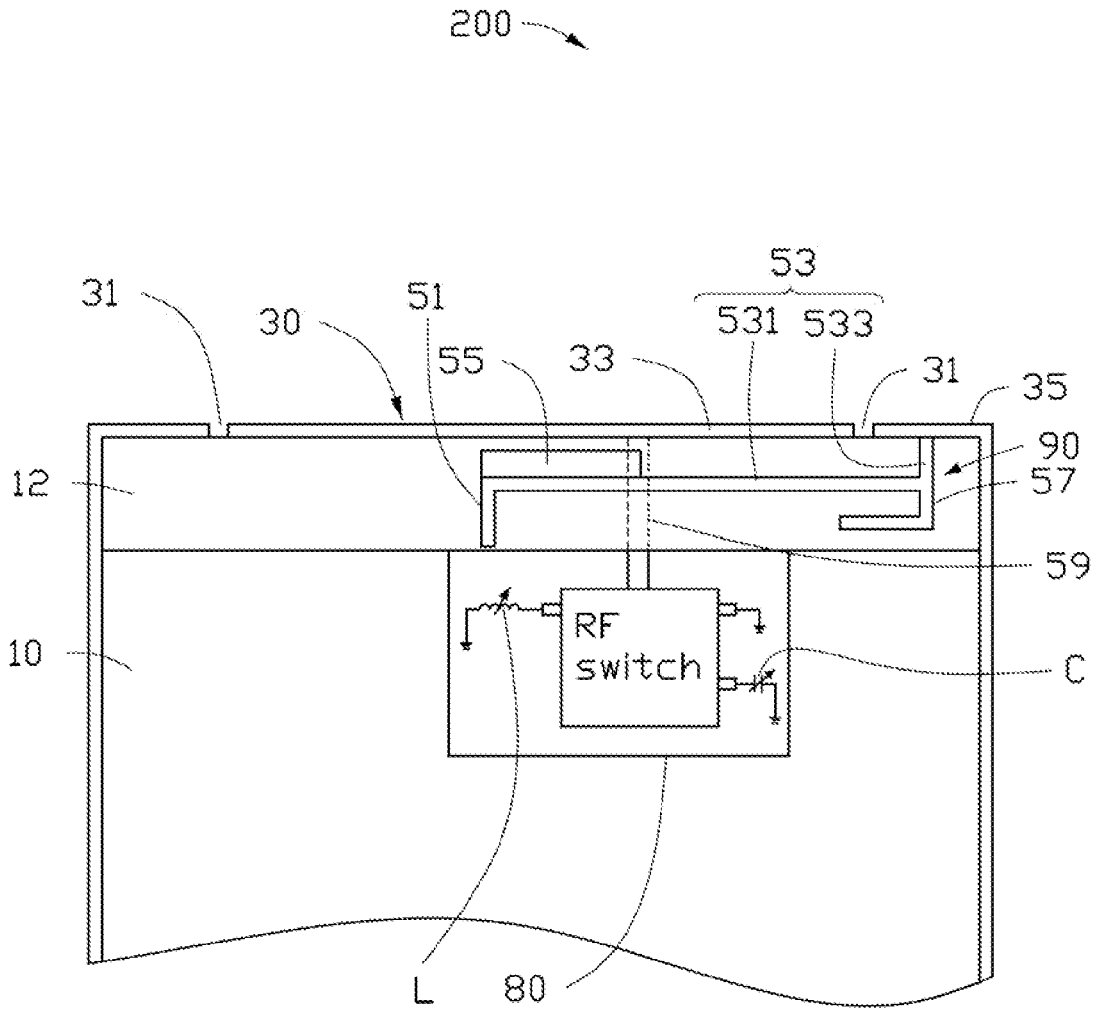
FIG. 5 is a diagrammatic view of a wireless communication device, according to a second exemplary embodiment.

FIG. 5 illustrates an embodiment of an antenna structure 90 of a wireless communication device 200, according to a second exemplary embodiment. The antenna structure 90 of the second exemplary embodiment is substantially same to the antenna structure 50 illustrated in the first exemplary embodiment, and a difference between the wireless communication device 200 and the wireless communication device 100 is that a switching circuit 80 is incorporated into the wireless communication device 200.

The switching circuit 80 is mounted on the baseplate 10, and may include a radio frequency (RF) switch that is directly grounded or is grounded by a variable inductor L or a variable capacitor C. The grounded end 59 is coupled to the RF switch. Thus, an impedance of the antenna structure 90 can be adjusted by changing a capacitance value of the variable capacitor C and/or the inductance value of the variable inductor L. A simulation result shows that the central frequency of the first low frequency mode gradually and the central frequency of the third high frequency mode will decrease while the inductance value of the variable inductor L increases, and also shows that the central frequency of the first low frequency mode will increase while the capacitance value of the variable capacitor C decreases. Thus, the first low frequency mode can be adjusted by changing the value of the variable inductor L and the value of the variable capacitor C to meet about 704 MHz to about 960 MHz, and the third high frequency mode can be adjusted by changing the value of the variable inductor L to meet about 1710 MHz to about 2690 MHz.

In summary, the metallic housing 30 defines two slits 31 to divide the metallic housing 30 into three parts, and thus the bottom frame 33 and the side frame 35 can be served as a part of the antenna structure 50, 90, which allows further size reductions of the wireless communication device 100, 200 employing the antenna structure 50,90. In addition, a radiating capability of the antenna structure 90 of the wireless communication device 200 is effectively improved because of the switching circuit 80.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A wireless communication device comprising:

a metallic housing comprising a bottom frame and a side frame spaced from the bottom frame; and an antenna structure comprising:

a feed end plate;

a ground end plate coupled to the bottom frame;

a main radiator coupled between the feed end plate and the side frame; and a coupling section coupled to the main radiator and extending parallel to the bottom frame;

wherein a first end of the coupling section is coupled to a distal end of the feed end plate, and a second end of the coupling section extends towards the ground end plate, current is coupled from the feed end plate to the ground end plate via the coupling section and is coupled from the coupling section to the bottom frame;

wherein the main radiator comprises a radiation section and a connection section, the radiation section is perpendicularly connected to the feed end plate and extends towards the side frame, the connection section is perpendicularly connected between the radiation section and the side frame.

2. The wireless communication device as claimed in claim 1, wherein the coupling section is connected to a side of the radiation section.

3. The wireless communication device as claimed in claim 1, wherein the antenna structure further comprises an extension section coupled to a junction of the radiation section and the connection section.

4. The wireless communication device as claimed in claim 3, wherein the extension section extends away from the connection section and bends towards the feed end plate.

5. The wireless communication device as claimed in claim 3, further comprising a baseplate, wherein the baseplate forms a keep-out-zone, a feed pin and a ground pin are formed on the keep-out-zone, the feed end plate is coupled to the feed pin, and the ground end plate is coupled to the ground pin.

6. The wireless communication device as claimed in claim 5, wherein the feed end plate, the main radiator, the coupling section, and the extension section are located at a first plane of the keep-out-zone, and the ground end plate is located at a second plane of the keep-out-zone.

7. The wireless communication device as claimed in claim 3, wherein the metallic housing defines two slits to divide the metallic housing into the bottom frame and the side frame.

8. The wireless communication device as claimed in claim 7, wherein the bottom frame is positioned at an end of the keep-out-zone, and the side frame surrounds the baseplate.

9. The wireless communication device as claimed in claim 1, further comprising a switching circuit, wherein the switching circuit comprises a radio frequency (RF) switch that is directly grounded or is grounded by a variable inductor or a variable capacitor, and the grounded end is coupled to the RF switch.

10. An antenna structure comprising:

a bottom frame;

a side frame spaced from the bottom frame a feed end plate;

a ground end plate coupled to the bottom frame;

a main radiator coupled between the feed end plate and the side frame; and a coupling section coupled to the main radiator and extending parallel to the bottom frame;

wherein a first end of the coupling section is coupled to a distal end of the feed end plate, and a second end of the coupling section extends towards the ground end plate, current is coupled from the feed end plate to the ground end plate via the coupling section and is coupled from the coupling section to the bottom frame;

wherein the main radiator comprises a radiation section and a connection section, the radiation section is perpendicularly connected to the feed end plate and extends towards the side frame, the connection section is perpendicularly connected between the radiation section and the side frame.

11. The antenna structure as claimed in claim 10, wherein the coupling section is connected to a side of the radiation section.

12. The antenna structure as claimed in claim 10, further comprising an extension section, wherein the extension section is coupled to a junction of the radiation section and the connection section.

13. The antenna structure as claimed in claim 12, wherein the extension section extends away from the connection section and bends towards the feed end plate.

14. A wireless communication device comprising:

a metallic housing comprising a bottom frame and a side frame spaced from the bottom frame;

an antenna structure comprising:

a feed end plate;

a ground end plate coupled to the bottom frame;

a main radiator coupled between the feed end plate and the side frame; and a coupling section coupled to the main radiator and extending parallel to the bottom frame; and a switching circuit;

wherein a first end of the coupling section is coupled to a distal end of the feed end plate, and a second end of the coupling section extends towards the ground end plate, current is coupled from the feed end plate to the ground end plate via the coupling section and is coupled from the coupling section to the bottom frame;

wherein the switching circuit comprises a radio frequency (RF) switch that is directly grounded or is grounded by a variable inductor or a variable capacitor, and the grounded end is coupled to the RF switch.

15. The wireless communication device as claimed in claim 14, wherein the main radiator comprises a radiation section and a connection section, the radiation section is perpendicularly connected to the feed end plate and extends towards the side frame, the connection section is perpendicularly connected between the radiation section and the side frame, the coupling section is connected to a side of the radiation section.

16. The wireless communication device as claimed in claim 15, wherein the antenna structure further comprises an extension section coupled to a junction of the radiation section and the connection section.

17. The wireless communication device as claimed in claim 16, wherein the extension section extends away from the connection section and bends towards the feed end plate.

18. The wireless communication device as claimed in claim 17, further comprising a baseplate, wherein the baseplate forms a keep-out-zone, a feed pin and a ground pin are formed on the keep-out-zone, the feed end plate is coupled to the feed pin, and the ground end plate is coupled to the ground pin.

19. The wireless communication device as claimed in claim 18, wherein the feed end plate, the main radiator, the coupling section, and the extension section are located at a first plane of the keep-out-zone, and the ground end plate is located at a second plane of the keep-out-zone.

* * * * *